US006205667B1

(12) United States Patent
Glesser

(10) Patent No.: US 6,205,667 B1
(45) Date of Patent: Mar. 27, 2001

(54) KNIFE WITH A NON-ROTATING RETRACTABLE BLADE

(75) Inventor: Louis S. Glesser, Golden, CO (US)

(73) Assignee: Spyderco, Inc., Golden, CO (US)

( * ) Notice: Subject to any disclaimer, the term of this patent is extended or adjusted under 35 U.S.C. 154(b) by 0 days.

(21) Appl. No.: 09/250,216

(22) Filed: Feb. 15, 1999

(51) Int. Cl.[7] ..... B26B 1/08
(52) U.S. Cl. ..... 30/162; 30/151; 30/335
(58) Field of Search ..... 30/151, 162, 335, 30/294, 315; D8/99

(56) References Cited

U.S. PATENT DOCUMENTS

| | | | | |
|---|---|---|---|---|
| D. 105,334 | * | 7/1937 | Mahoney | D8/99 |
| 471,107 | * | 1/1892 | Dunn | 30/162 |
| 1,500,644 | * | 7/1924 | Scalbom | 30/162 |
| 1,843,970 | * | 2/1932 | Bodkin | 30/162 |
| 2,023,262 | * | 12/1935 | Bensel | 30/162 |
| 2,566,493 | * | 9/1951 | Ladd | 30/162 |
| 2,578,896 | * | 12/1951 | Moore | 30/162 |
| 4,447,950 | * | 5/1984 | Mizelle | 30/155 |
| 4,959,905 | * | 10/1990 | Ghislain | 30/151 |
| 5,546,662 | * | 8/1996 | Seber et al. | 30/161 |

FOREIGN PATENT DOCUMENTS

| | | | | |
|---|---|---|---|---|
| 2253805 | * | 9/1992 | (GB) | 30/335 |

* cited by examiner

*Primary Examiner*—Hwel-Slu Payer
(74) *Attorney, Agent, or Firm*—Sheridan Ross P.C.

(57) ABSTRACT

A handheld knife having a non-rotating retractable blade which reversibly travels between a position of storage within the knife handle and an extended position of use in a direction which is substantially perpendicular to a longitudinal axis of the knife handle.

24 Claims, 5 Drawing Sheets

KNIFE WITH A NON-ROTATING RETRACTABLE BLADE

FIELD OF THE INVENTION

The present invention relates to cutting instruments, and more particularly handheld knives with retractable blades.

BACKGROUND OF THE INVENTION

Cutting instruments, and more specifically handheld knives, have been used for generations and even centuries by hunters, craftsmen and soldiers. These knives are generally characterized by a metallic blade with a sharpened cutting edge and a handle to both hold the blade and to be held by the user for safety purposes.

Fixed blade knives extend from the handle and are incapable of being folded or otherwise storing the blade in a position where the knife blade cutting surface is not exposed. Thus, these knives can be dangerous if not used and stored properly.

Handheld knives which store the knife blade in a non-exposed position during non-use are generally characterized by three different types. These include folding knives, switchblade knives and stilettoes.

With a folding knife, the blade generally rotates about a pivot pin near the front of the knife handle between a first extended position and a second closed position. In the first open position the knife blade is substantially coextensive with the longitudinal axis of the knife handle. In the second closed position, all or a portion of the knife blade cutting edge is received within a cavity defined in the handle which substantially prevents the cutting edge of the knife blade from being exposed. With a typical folding knife, the blade is opened and closed between the first extended position and second closed position manually. Unfortunately, folding knives may be cumbersome since a large portion of the blade is still exposed even when the blade is in a closed position and thus has the potential of inadvertently opening if the blade is caught or snagged.

Switchblade knives are constructed in a similar manner to folding knives with the knife blade rotating about a pivot pin near the front of the knife handle. However, they are spring loaded, and thus open very quickly when a button is pressed or a switch is activated which releases the spring. These knives are illegal in most states and foreign countries due to their inherent danger.

Stilettoes are distinct from folding knives and switchblade knives since the knife blade does not rotate about a pivot pin near the front of the handle. Rather, the blade is stored within the knife handle and is extended to a first position of use by the blade being thrust forward in a direction which is substantially coextensive with the knife handle. Thus, the knife blade does not rotate about a pivot pin and is exposed for use with the knife blade extending directly outward from the cavity within the handle. The knife blade may be extended manually or more commonly mechanically by the use of a spring. Stilettoes are also illegal in many states and countries, since the blade is concealed and the mechanical energy provided by the spring can make them inherently dangerous.

Cutting instruments known as an "ulu" knife have also known in the art and are characterized by a fixed, nonmoving blade having a longitudinal axis consistent with the length of the knife handle. These types of knives have been used extensively by Eskimos and many native American Indians. The "ulu" knife blade is unique from most knives since the cutting edge is positioned substantially parallel to the longitudinal axis of the knife handle. This orientation makes the knife well suited for skinning animals and for use in a "rolling" motion when a downward force is applied. Unfortunately, these non-folding knives are bulky to carry and have an exposed cutting edge at all times, thus requiring the use of a sheath for safety purposes.

Thus, many of the knife designs discussed above are impractical, cumbersome to carry, are potentially dangerous, or are illegal to own. Further, due to the generally linear shapes of most knife blades, they are not practical for use for skinning or chopping with a rolling motion when a more arcuate shaped cutting edge is preferred. Finally, the pointed tip on most conventional blades can be dangerous if a person were to inadvertently fall on the tip. What is needed is a safe, handheld knife with a blade positioned substantially parallel to the longitudinal axis of the handle which can travel between a first extended position of use and second closed position with the blade cutting edge stored in the handle in a safe, efficient manner.

SUMMARY OF THE INVENTION

It is thus an object of the present invention to provide a lightweight, handheld cutting instrument with a retractable blade that travels between a first position of use with the blade cutting edge exposed and a second retracted position where the blade is protected within a cavity of the knife handle and the blade cutting edge is not exposed.

Thus, in one aspect of the present invention a knife is provided with a handle that has a cavity for receiving a knife blade along a substantially longitudinal axis extending from the front end of the knife handle to the rear end of the knife handle. The knife blade, having a similar longitudinal length extending from a first end to a second end of the knife blade, retracts into the knife handle at a substantially right angle to the longitudinal axis of the knife handle and blade.

It is yet another aspect of the present invention to provide a portable, lightweight folding knife which can be manually opened and closed with one hand. Thus, in another aspect of the present invention, a mechanism is provided which allows the blade to be reversibly extended and retracted from the knife handle with pressure applied merely from a user's thumb or finger.

It is yet another aspect of the present invention to provide a portable cutting instrument which is compact in size, safe, yet carries a blade cutting edge with a sufficient length to be useful for cutting, skinning, chopping and other purposes commonly required of handheld cutting instruments. Thus, in one aspect of the invention, a knife with a retractable blade is provided with the cutting edge of the blade extending substantially the entire longitudinal length of the knife handle.

It is a further object of the present invention to provide a knife with a blade with an arcuate geometric shape which extends substantially from a first end of the knife blade cutting edge to a second edge of the knife blade cutting edge. This geometric shape of the knife blade makes the knife especially useful for certain operations such as skinning an animal, chopping and the blade to be used in a fashion which is not fatiguing to the user's hand, wrist or arm. Furthermore, with this type of blade configuration (without a pointed end) the blade cannot be used for stabbing and is thus significantly safer than typical handheld knives.

DETAILED DESCRIPTION OF THE PREFERRED EMBODIMENT

Subtitles

Figure 1:
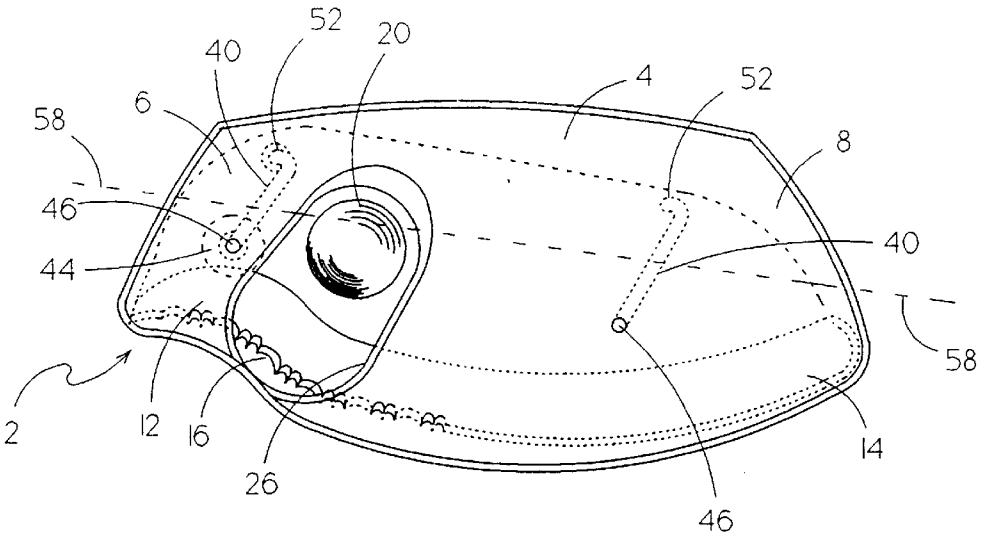
FIG. 1 is a front elevation view of the knife with the blade enclosed within a cavity in the handle.
Figure 3:
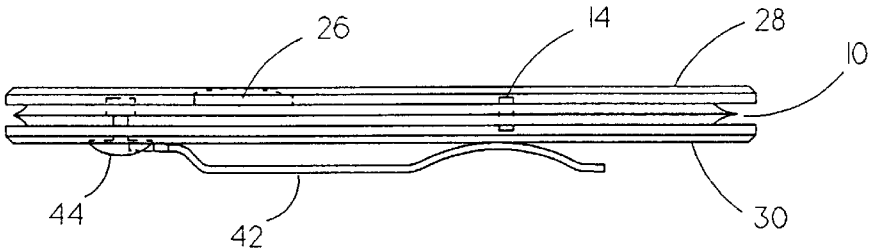
FIG. 3 is a bottom plan view of the knife shown in FIG. 1.
Figure 4:
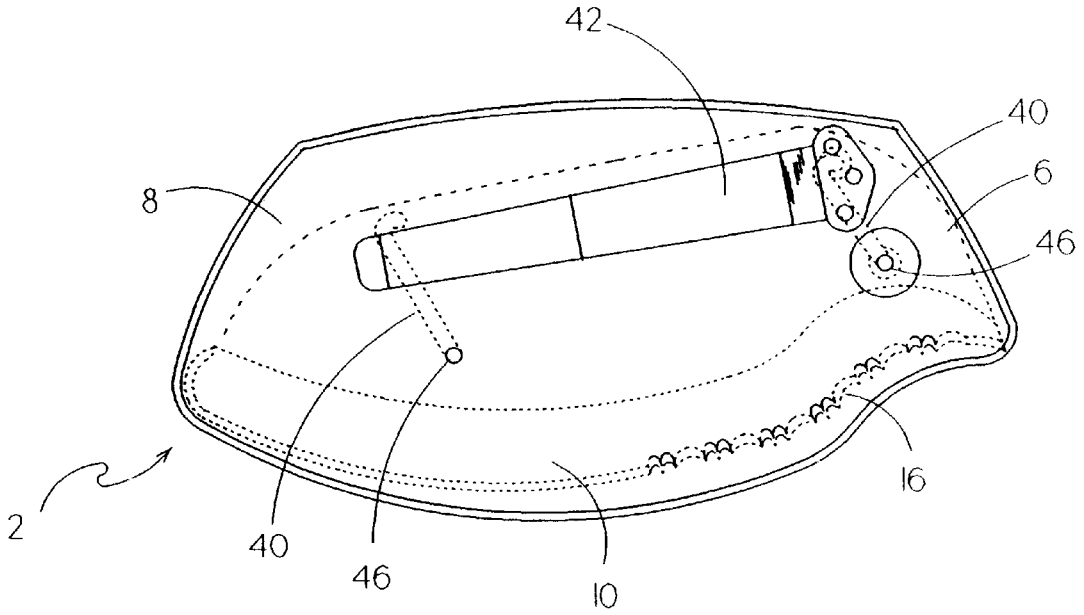
FIG. 4 is a rear elevation view of the knife shown in FIG. 1.
Figure 5:
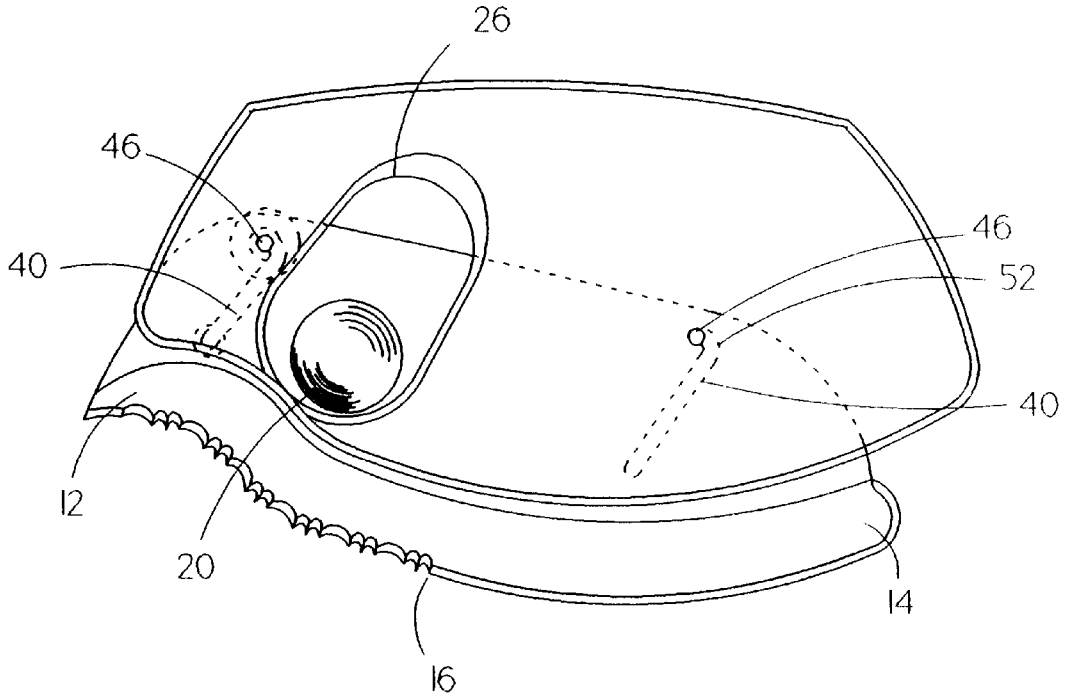
FIG. 5 is a front elevation view of the knife shown in FIG. 1, with the blade extended to a first position of use.

Referring now to the drawings, FIGS. 1 through 5 illustrate one particular embodiment of the present invention showing the knife blade in both a retracted position for storage purposes and a second extended position of use. FIGS. 1 through 4 depict the knife 2 with the knife blade 10 received within the handle cavity 18 of the knife. FIG. 5 shows the knife 2 with the knife blade 10 extended in a position of use. In general the hand held knife 2 comprises a knife handle 4 which is comprised of a front scale 28 and rear scale 30 which defines a handle cavity 18 for receiving a knife blade 10. The knife handle is generally comprised of a handle front end 6, a handle rear end 8 and a handle aperture 26 which allows a user of the knife to engage a knife blade depression 20. Contrary to the positioning of most knife blades in knife handles, the present invention incorporates a knife blade 10 which travels in a direction substantially perpendicular to the longitudinal axis of the knife handle 4. Thus, as seen in FIG. 1, when pressure is applied to the blade depression 20 by a user's thumb, the knife blade 10 is extended outward to a first position of use as shown in FIG. 5.

Figure 2:
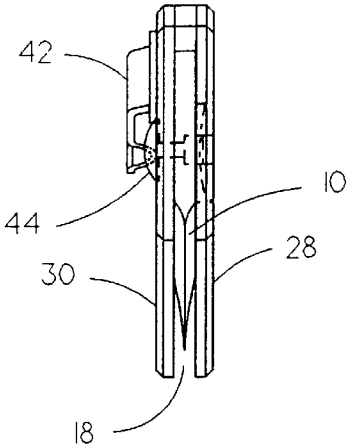
FIG. 2 is a left end view of the knife shown in FIG. 1.

When the knife blade 10 is not being used, the knife blade 10 can be retracted back into the knife handle cavity 18 by pressure being applied to the blade depression 20 in the opposite direction. As seen in FIG. 2, the knife blade 10 in a retracted position is received in the knife handle cavity 18 for safety purposes to assure that the blade cutting edge 16 is not exposed.

To accommodate the attachment of the knife to a user's belt, pocket or other object, a clip 42 is interconnected to either the front scale 28 or rear scale 30. Preferably, the knife clip 42 is positioned on the scale which is opposite the handle aperture 26. The clip 42 is preferably constructed of a metallic material for strength, although other material such as rigid plastics may be used to achieve the same purpose. The clip 42 is attached to the knife handle 4, i.e. front scale 28 or rear scale 30 by means of a stud 44. The stud 44 is preferably made of stainless steel, or other metallic materials although plastics may functionally serve the same purpose. Alternatively, the clip may be integrally molded into one of the scales as a single piece, thus eliminating the need for a stud 44 or pin.

Referring back to FIG. 1, one particular embodiment of the present invention is shown which accommodates the movement of the knife blade 10 from a first extended position of use to a second retracted position with the knife blade cutting edge 16 received within the knife handle 4. In this particular embodiment, one or more positioning slots 40 are cut out of the knife blade 10 to accommodate receiving one or more studs 46 which are interconnected to either the front scale 28, the real scale 30, or both. Alternatively, the positioning slots 40 may be cut out of either the front scale 28, rear scale 30, or both while the stud(s) 46 is interconnected to the knife blade 10 to engage the positioning slots 40. In use, when pressure is applied downwardly on the blade depression 20 in a direction toward the knife blade cutting edge 16, the stud 46 rides within the positioning slot 40 to allow movement of the knife blade 10 in a downward direction, thus exposing the knife blade cutting edge 16. When the stud 46 reaches the end of the positioning slot 40, it becomes engaged in the slot hook arm 52 to effectively lock the blade and to prevent any inadvertent movement as shown in FIG. 5. As identified in the drawings, when the blade is in a second retracted position within the blade handle, the blade cutting edge 16 is not exposed for obvious safety purposes.

The knife blade 10 as shown in FIGS. 1 through 8 generally has a longitudinal axis which is consistent with the longitudinal axis of the knife handle 4. On the lower end of the knife blade is a knife cutting edge 16 which may have a typical sharpened blade edge or a serrated blade edge as shown in the drawings. Preferably, the knife blade cutting edge 16 has an arcuate shape from the knife blade first end 12 to the blade second end 14. This arcuate shape of the knife blade 10 allows the knife blade 10 to be used in a rolling motion when cutting any particular item which makes it very functional for cutting certain objects such as vegetables or for removing the skin of an animal.

Referring now to FIG. 5, the knife blade 10 is shown in a first extended position outside the handle cavity 18 in a position of use. When the blade is extended, the studs 46 are positioned within the slot hook arms 52 to prevent the knife blade 10 from retracting into the knife handle cavity 18 inadvertently. Alternatively, other types of locking mechanisms can be used such as a stud extending through the blade, locking cams or other locking devices commonly known in the art. As can additionally be seen in this position, the blade depression 20 is now positioned at the lower end of the handle aperture 26. As the handle is grasped on the upper portion by a user, the knife blade 10 can be rolled back and forth or used in a sweeping motion for skinning purposes or other similar purposes.

Figure 6:
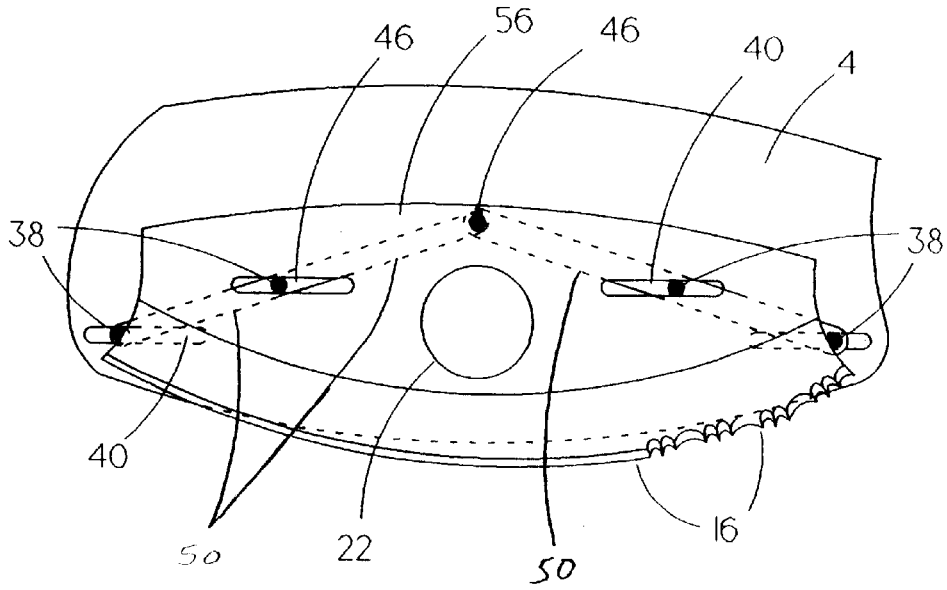
FIG. 6 is a front elevation view of an alternative knife design with the front scale removed for clarity purposes.
Figure 7:
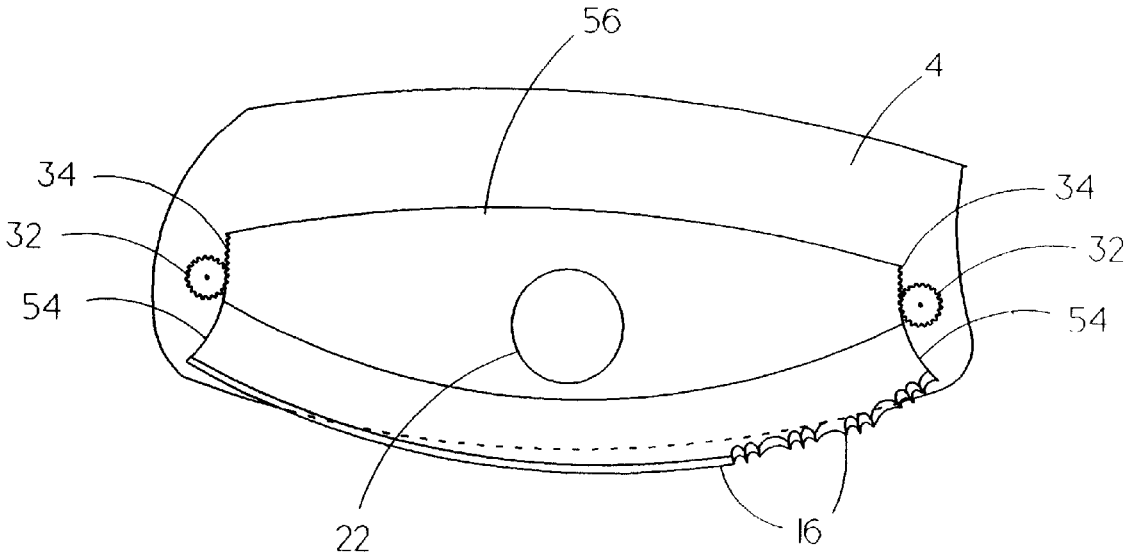
FIG. 7 is a front elevation view of an alternative knife design with the front scale removed for clarity purposes.
Figure 8:
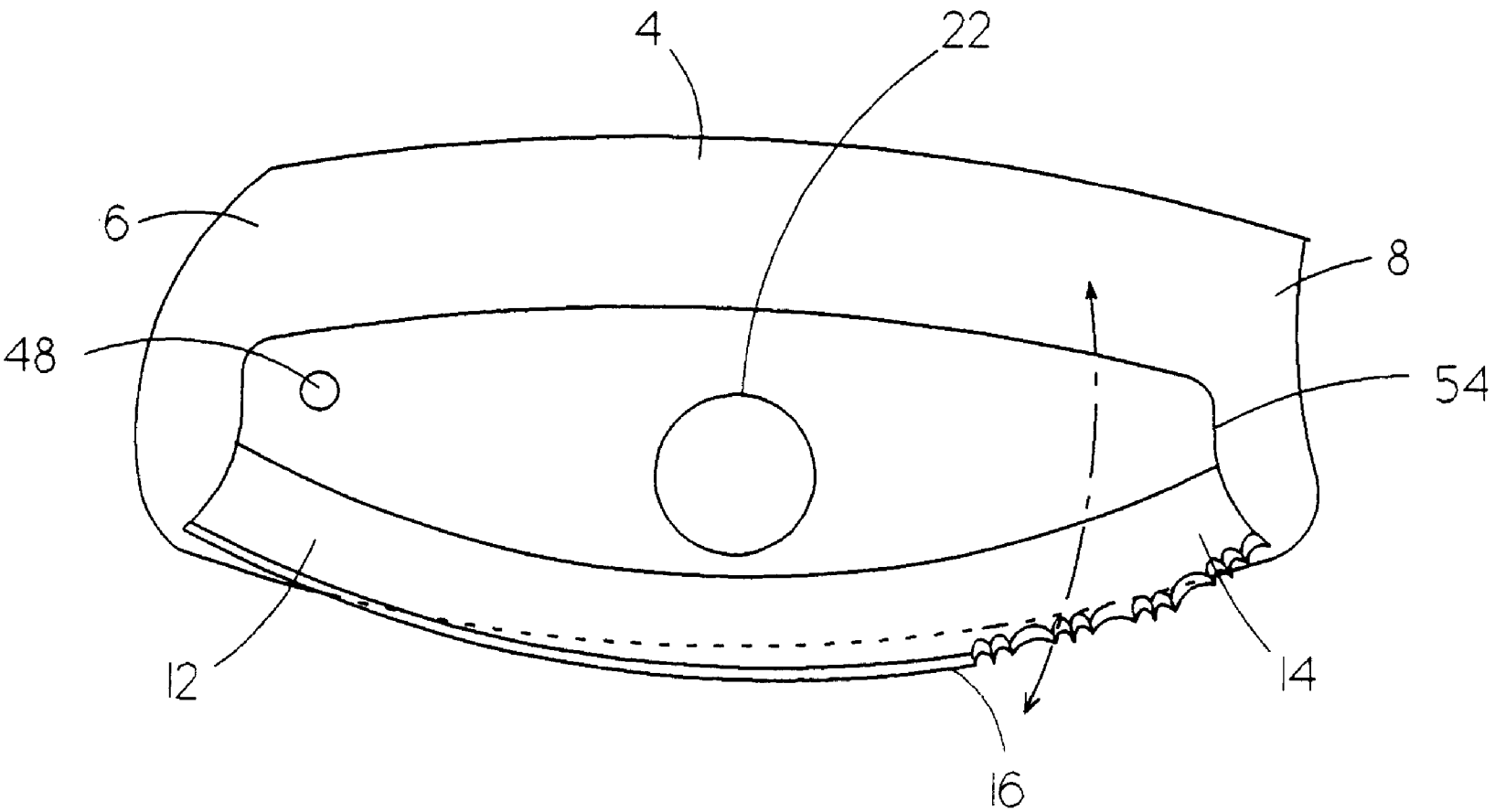
FIG. 8 is a front elevation view of an alternative knife design with the front scale removed for clarity purposes.
Figure 9:
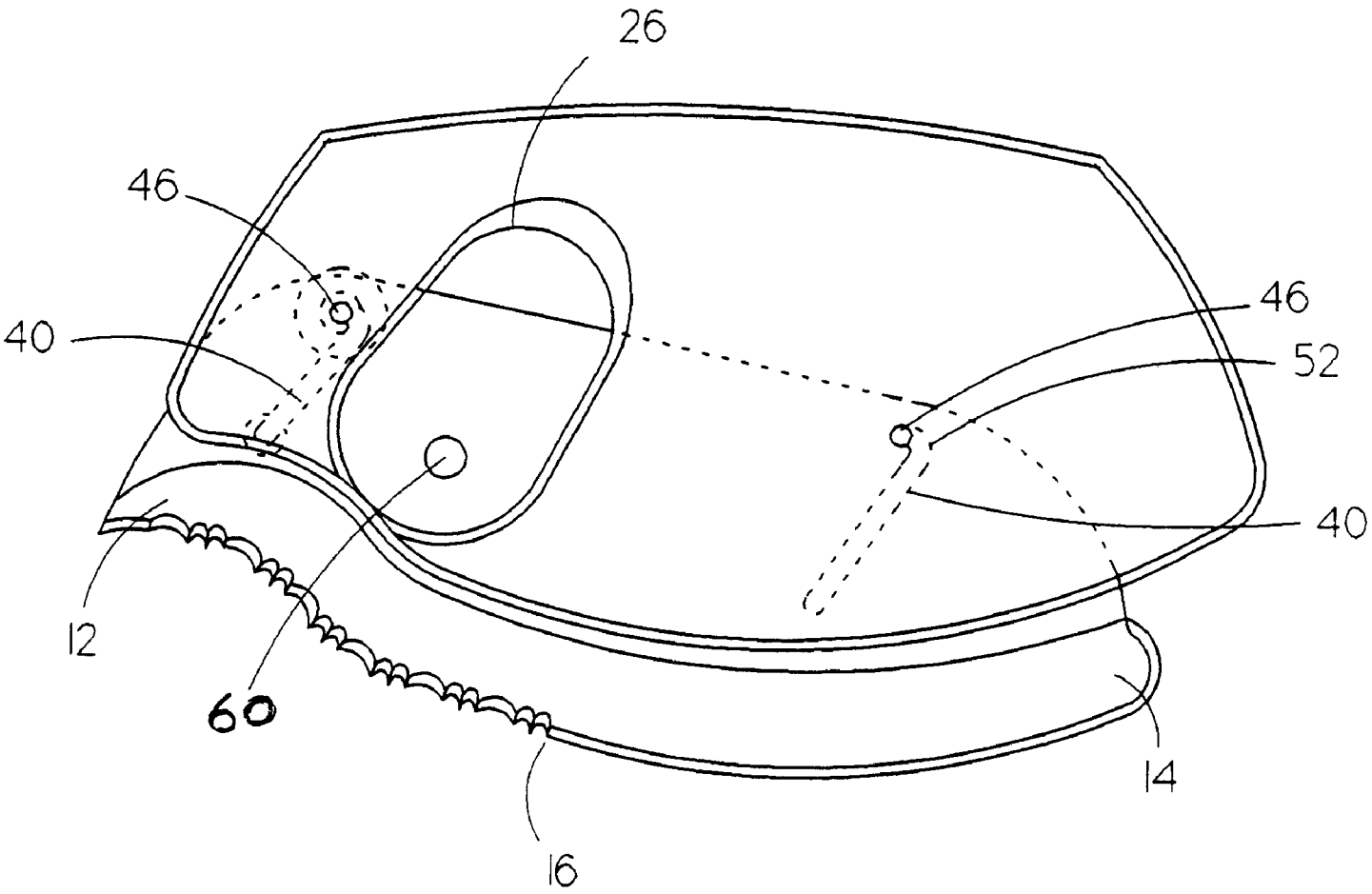
FIG. 9 is a front elevation view of an alternative knife design with a thumb stud interconnected to the knife blade.

Referring now to FIG. 6 through 8, alternative blade retraction mechanisms are provided for allowing the blade to travel between the first extended position of use and the second retracted position. In each of these figures, the front scale 28 has been removed for illustration purposes to more clearly identify the position of the knife blade 10 and the knife handle 4 and the blade retraction mechanism. Additionally, in each of the alternative embodiments shown the blade depression 20 has been replaced with a blade aperture 22 which is an aperture extending entirely through the knife blade 10 rather than merely being a blade depression 20 for engagement by a user's thumbs. Additionally, the blade aperture 22 is positioned centrally between the blade first end 12 and the blade second end 14 rather than in a forward position as shown in FIGS. 1 through 5.

Referring again to FIG. 6, the blade retraction mechanism in this embodiment generally comprises a pair of traveling arms 50 which are interconnected to a pin or stud 46 which is positioned near the upper edge of the knife blade 10 at a position approximately midway between the blade lateral edges 54. The blade 10 is additionally interconnected to two or more alignment pins 38, which are positioned in distinct positions on the knife blade 10 below the upper stud 46 or pin. The alignment pins 38 travel within corresponding positioning slots 40 which are positioned in either the front scale 28, the rear scale 30, or both. During use, as force is applied downward to the blade aperture 22 in the direction of the blade cutting edge 16, the traveling arms 50 move downward pushing the alignment pins 38 in an outwardly direction, thus allowing the knife blade cutting edge 16 to travel downward and out of the blade cavity 18. Once the blade is in its completely extended position, the traveling arms 50 extend into a fixed position. To prevent the inadvertent movement of the knife blade from its extended position, a locking mechanism may be incorporated which utilizes a locking pin, cam, or other similar device commonly known in the art. To move the knife blade from the first extended position to a second retracted position within the knife handle, force is applied to the blade aperture 22 in an upward direction opposite the blade cutting edge. As force is applied, the alignment pins 38 move inward within the positioning slots 40 as the traveling arms move upward to the position shown in FIG. 6.

Referring now to FIG. 7, an alternative embodiment of the present invention is shown which incorporates a pair of positioning gears 32 interconnected to either the front scale 28, the rear scale 30 or both. In operable relationship with each of the positioning gears 32 are positioning teeth 34 which are cut into each of the lateral edges of the knife blade 10. When downward pressure is applied to the blade aperture 22 in a direction toward the blade cutting edge 16 by a user's thumb, the positioning gears 32 engage the positioning teeth 34 of the knife blade 10 and the knife blade extends outside of the handle cavity 18. Correspondingly, when the knife blade is desired to be in a retracted position, pressure is applied upward on the blade aperture 22 in a direction opposite the blade cutting edge 16, thus allowing the positioning teeth 34 to operatively engage the positioning gears 32 until the knife blade 10 moves upward into the knife cavity. To facilitate locking the blade into a first extended position of use a locking mechanism such as a stud may be utilized which extends from the handle through the knife blade 10. Alternatively, a biased cam mechanism may be used as well as other locking devices commonly known in the art.

Referring now to FIG. 8, an alternative embodiment of the present invention is shown wherein the knife blade 10 actually pivots about a pivot pin 48 which is positioned near the handle front end 6. Thus, as pressure is applied by a user to the blade aperture 22, the blade second end 14 rotates about the blade pivot pin 48 in a clockwise rotation. Thus, the blade second end 14 becomes exposed first from the blade cavity while the remainder of the blade follows as the blade is pivoted around the pivot pin 48. To facilitate locking the blade into position, it is anticipated that a stud, cam or other similar type device can be employed as discussed above.

While various embodiments of the present invention have been described in detail, it is apparent that further modifications and adaptations of the invention will become apparent to those skilled in the art. However, it is to be expressly understood that such modifications and adaptations are within the sphere and scope of the present invention. For clarity, the numbering of the various components identified in the figures are provided herein.

COMPONENT LIST

| # | Component | # | Component |
|---|---|---|---|
| 02 | Knife | 30 | Rear Scale |
| 04 | Knife Handle | 32 | Positioning Gears |
| 06 | Handle Front End | 34 | Positioning Teeth |
| 08 | Handle Rear End | 36 | Alignment Rods |
| 10 | Knife Blade | 38 | Alignment Pins |
| 12 | Blade First end | 40 | Positioning Slots |
| 14 | Blade Second End | 42 | Clips |
| 16 | Blade Cutting Edge | 44 | stud |
| 18 | Handle Cavity | 48 | Pivot Pin |
| 20 | Blade Depression | 50 | Traveling Arms |
| 22 | Blade Aperture | 52 | Slot Hook Arm |
| 24 | Blade Stud | 54 | Blade Lateral Edge |
| 26 | Handle Aperture | 56 | Blade Upper Edge |
| 28 | Front Scale | 58 | Handle longitudinal axis |
| | | 60 | thumb stud |

What is claim is:

1. A cutting instrument with a retractable blade which travels in a direction which is substantially perpendicular to a longitudinal axis of said cutting instrument, comprising:

a) a handle having a first scale operably opposed and interconnected to a second scale;

b) a retractable blade having a substantially arcuate shaped cutting edge which extends substantially between a first end and a second end of said retractable blade;

c) a cavity positioned between said first scale and said second scale for receiving said retractable blade;

d) a blade engagement means operably positioned on said retractable blade to permit a user of said retractable blade to operably move said retractable blade with a thumb between a first extended position of use and a second retracted position wherein said cutting edge is positioned within said cavity;

e) a handle aperture operatively positioned in one of said scales which is operably sized to provide access to said blade engagement means by a user's thumb; and f) a blade retraction means having a first end operably interconnected to at least one of said scales and a second end operably engaged to said retractable blade, wherein said retractable blade can reversibly travel between said first extended position of use and said second retracted position.

2. The cutting instrument of claim 1, wherein said blade engagement means comprises a thumb stud interconnected to said retractable blade in a position proximate to said handle aperture and extending in a direction substantially perpendicular to a planar surface of said retractable blade.

3. The cutting instrument of claim 1, wherein said blade engagement means comprises an aperture extending through said retractable blade in a position proximate to said handle aperture.

4. The cutting instrument of claim 1, wherein said blade engagement means comprises a depression partially recessed within said retractable blade in a position proximate to said handle aperture.

5. The cutting instrument of claim 1, wherein said blade retraction means comprises a stud interconnected to said blade which operably travels within a slot positioned within at least one of said scales, said slot extending in a direction substantially perpendicular to said longitudinal axis of said cutting instrument.

6. The cutting instrument of claim 1, wherein said blade retraction means comprises a plurality of gears interconnected to said handle proximate to said cavity for operable engagement to a plurality of teeth which are integral to a lateral edge of said cutting instrument retractable blade.

7. The cutting instrument of claim 1, further comprising locking means interconnected to said handle and operably engaged to said blade for securing said blade in said first extended position of use.

8. A knife with a non-folding, retractable cutting blade, comprising:

a blade having a first end, a second end and a substantially arcuate shaped cutting edge extending substantially therebetween;

a handle having a front end and a rear end which defines a substantially longitudinal axis and a cavity extending therebetween for receiving said blade;

a blade retraction means interconnected to said handle proximate to said cavity and operatively engaged with said blade to move said first end and said second end of said blade substantially simultaneously in a direction at substantially right angles to said longitudinal axis of said handle between a first extended position of use wherein said blade cutting edge is exposed for use and a second retracted position wherein said blade cutting edge is received within said handle; and a blade engagement means positioned on said knife blade and adapted for contact with a thumb of a user of said knife, wherein said knife blade moves between said first extended position of use and said second retracted position when a force is applied to said blade engagement means in a direction substantially at right angles to the longitudinal axis of said handle by the thumb of the user.

9. The knife of claim 8, wherein said blade retraction means comprises at least one slot positioned within said handle proximate to said cavity and sized to receive a stud operatively interconnected to said blade, wherein said stud is in sliding engagement with said slot.

10. The knife of claim 8, wherein said blade retraction means comprises at least one slot in said blade and sized to receive a stud operatively interconnected to said handle proximate to said cavity, wherein said stud is in sliding engagement with said slot.

11. The knife of claims 9 or 10, wherein said slot further comprises a slot hook arm positioned on the upper end of said slot for engaging said stud in a position which secures said blade in said first extended position.

12. The knife of claim 8, wherein said blade retraction means comprises a pair of opposing traveling arms having first ends interconnected to said blade proximate to an upper edge of said blade and a second end interconnected to at least two alignment pins which are slidingly engaged with an opposing slot positioned within said handle proximate to said cavity, wherein when a force is applied to said blade engagement means in a direction toward said blade cutting edge, said knife blade travels downward exposing said knife blade cutting edge.

13. The knife of claim 8, wherein said blade engagement means comprises an aperture extending through said blade.

14. The knife of claim 8, wherein said blade engagement means comprises a thumb stud interconnected to said knife blade and which extends outwardly from said knife blade.

15. The knife of claim 8, wherein said blade engagement means comprises a depression in said blade which is adapted for contact with said user's thumb.

16. The knife of claim 8, wherein said handle further comprises a handle aperture operably sized to receive a user's thumb to contact said blade engagement means, wherein said blade can be reversibly moved between said second retracted position and said first extended position of use.

17. The knife of claim 8, wherein said blade retraction means comprises a plurality of gears interconnected to said handle and positioned proximate to said cavity for operable engagement with a plurality of teeth interconnected on at least one lateral edge of said knife blade.

18. The knife of claim 8, further comprising a clip interconnected to said handle which is adapted for removably interconnecting said knife to an object such as an article of clothing.

19. The knife of claim 8, wherein said handle is comprised of a first scale which substantially opposes and is interconnected to a second scale, said cavity defined therebetween.

20. The knife of claim 8, further comprising locking means interconnected to said handle and operably engaged to said knife blade in said first extended position of use.

21. A handheld knife having a non-rotating, retractable blade, comprising:

a handle comprising a front end and a rear end which defines a longitudinal axis, and a cavity extending therebetween;, a blade having a first end, a second end and a cutting edge extending therebetween, said knife blade having a total length no greater than a length of said knife handle;

a blade depression partially recessed within said blade and operably positioned for engagement by a thumb of a user of said handheld knife;

a handle aperture extending from an outer section of said knife handle to said cavity, wherein said blade depression is exposed for engagement by a user's thumb;

at least one stud operably interconnected to said blade and extending outwardly in a direction substantially perpendicular to a plane of said knife blade; and at least one slot positioned within said handle adjacent said cavity and aligned to operably receive said stud, wherein said knife blade reversibly travels at substantially a right angle to said longitudinal axis of said handle between a first position of use with said knife blade cutting edge exposed and a second retracted position wherein said knife blade cutting edge is received within said cavity.

22. The handheld knife of claim 21, further comprising a clip interconnected to said handle for removably interconnecting said handheld knife to an article of clothing.

23. The handheld knife of claim 21, further comprising locking means interconnected to said handheld knife handle and in operable engagement with said blade, wherein said knife blade can be secured in said first extended position.

24. A knife with a non-folding, retractable cutting blade, comprising:

a blade having a first end, a second end, and a substantially arcuate shaped cutting edge extending substantially therebetween;

a handle having a front end and a rear end which defines a substantially longitudinal axis and a cavity extending therebetween for receiving said blade, said handle further having an access slot positioned in a direction substantially normal to said longitudinal axis of said handle; and a blade retraction means interconnected to said handle proximate to said cavity and operatively engaged with said blade to move said blade in a direction at substantially right angles to said longitudinal axis of said handle between a first extended position of use wherein said blade cutting edge is exposed for use and a second retracted position wherein said blade cutting edge is received within said handle; and a blade aperture extending through said knife blade in opposing relationship to said handle access slot and adapted for contact with a thumb of a user of said knife, wherein said knife blade moves reversely between said first extended position of use and said second retracted position when a force is applied to said blade aperture in a direction substantially at right angles to the longitudinal axis of said handle by the thumb of said user.

* * * * *